US012384498B2

(12) United States Patent
Isiminger

(10) Patent No.: US 12,384,498 B2
(45) Date of Patent: Aug. 12, 2025

(54) BUOYANT TRIM TAB ASSEMBLY

(71) Applicant: Charles Curry Isiminger, North Palm Beach, FL (US)

(72) Inventor: Charles Curry Isiminger, North Palm Beach, FL (US)

( * ) Notice: Subject to any disclaimer, the term of this patent is extended or adjusted under 35 U.S.C. 154(b) by 578 days.

(21) Appl. No.: 17/813,520

(22) Filed: Jul. 19, 2022

(65) Prior Publication Data

US 2023/0029325 A1 Jan. 26, 2023

Related U.S. Application Data

(60) Provisional application No. 63/225,000, filed on Jul. 23, 2021.

(51) Int. Cl.
*B63B 39/06* (2006.01)

(52) U.S. Cl.
CPC ..... *B63B 39/061* (2013.01)

(58) Field of Classification Search
CPC ..... B63B 39/00; B63B 39/061; B63B 39/06; B63B 1/00; B63B 1/08; B63B 1/22; B63B 1/32; B63H 5/00
USPC ..... 114/285
See application file for complete search history.

(56) References Cited

U.S. PATENT DOCUMENTS 5,385,110 A * 1/1995 Bennett ..... B63B 39/061 114/285
2011/0126751 A1* 6/2011 Muller ..... B63B 39/061 114/285

* cited by examiner

*Primary Examiner* — Lars A Olson
(74) *Attorney, Agent, or Firm* — McHale & Slavin, P.A.

(57) ABSTRACT

A method and apparatus for adding buoyancy to the transom of a boat by attaching buoyant material to the trim tabs, or to the planing surface of the trim tab, or constructing the trim tab itself of buoyant material. The buoyancy can be used to correct listing of a boat, or compensate for outboard engines that are unable to clear the water line when tilted up, or generally raise the stern of the boat while at rest. Buoyancy can be added to conventional trim tab plates or added to vertically extending interceptor blade type trim tabs. The invention also proposes a method by which trim tabs can be attached to the transom or the "step" or "pocket" above by a fixed or manually adjustable linkage, such as with a turnbuckle or jack screw or through-bolted perforated rods.

16 Claims, 7 Drawing Sheets

BUOYANT TRIM TAB ASSEMBLY

CROSS REFERENCE TO RELATED APPLICATION

In accordance with 37 C.F.R. 1.76, a claim of priority is included in an Application Data Sheet filed concurrently herewith. Accordingly, the present invention claims priority to U.S. Provisional Patent Application No. 63/225,000 entitled "BUOYANT TRIM TAB ASSEMBLY", filed Jul. 23, 2021. The contents of which are incorporated herein by reference.

FIELD OF THE INVENTION

The invention is directed to the field of boats and, in particular, a device for adding flotation to the transom of a boat by adding buoyancy to trim tabs.

BACKGROUND OF THE INVENTION

Trim tabs have been in use on boats for decades. They typically consist of a "plate" or other planing surface, which is typically affixed to the aft end of a boat, on the transom, or in some instances just forward of the transom under a "step" or "pocket" in the hull. Trim tabs can be fixed, and simply create additional planing surface in addition to the bottom of the boat hull. They generally are hinged at their leading edge, and have electric or hydraulic actuators extending from the upper surface of the trim tab plate to the transom of the boat, or into the "step" or "pocket" above.

Trim tabs are typically mounted in pairs, one on the starboard side and one on the port side of the boat's hull. The actuators are operated remotely and used to rotate the rear portion of the trim tab plates down and retract them upward. The starboard and port side trim tab are operated independently wherein the boat's planing attitude (angle) can be changed about the longitudinal axis (that angle is referred to as list) or the transverse axis (that angle is referred to as pitch). Some trim tabs don't have electric or hydraulic actuators, but rather have something similar to a "spring loaded" actuator which responds to more pressure on one side of the boat.

Trim tabs can also be "fixed," without electric, hydraulic, or spring loaded actuators. More recently, trim tabs called "interceptors" were developed that extend a "blade" vertically down below the hull.

All of these trim tabs develop their "trimming" properties from the boat's forward motion through the water. However, none of these trim tabs affect the boat's attitude, or how the boat floats in the water, while the boat is at rest (except that they may add a little bit of weight at the transom, causing the aft end of the boat to sit slightly lower in the water, but this is often negligible).

Many boats suffer from being too low in the water at the aft end while at rest. At times, this has been tolerated at some cost. At other times, this has been remedied with relatively expensive bolt-on motor brackets. One inconvenient and inefficient solution has been to place counterweights (such as buckets of water) on the bow while the boat is at rest, to try to raise the stern.

SUMMARY OF THE INVENTION

Disclosed a method and apparatus for adding buoyancy to the transom of a boat by use of the boat's trim tabs. The buoyant material is selected from the group consisting of:

foam, encapsulated foam, material significantly less dense than water, hollow structures of plastic, metal, fiberglass, composite, or other material. The attachment would be by adhesive or mechanical fasteners or, in another embodiment; the planing surface of the trim tab is manufactured from the buoyant material, or hollow structure of plastic, metal, fiberglass, composite, or other materials. The "plate" of the trim tab would have some significant thickness to it, and be less dense than water, to achieve buoyancy. The same buoyant materials or types of assemblies can be added to vertically extending interceptor blade type trim tabs.

An objective of the invention is to provide additional floatation to the aft portion of a boat by use of trim tabs.

Still another objective of the invention is to provide additional floatation to the aft portion of a boat without modification to the hull of the boat itself, providing a relatively inexpensive way to provide additional flotation at the stern using modified trim tabs.

Yet still another objective of the invention is to provide floatation to boat to keep lower unit of outboard motor(s) out of the water, or higher in the water, when the motors are tilted up to prevent or reduce marine fouling of the motor.

Another objective of the invention is to provide floatation to boat to correct imbalanced loading, such as from a marine battery, a kicker motor, stowing of gear, or the like.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
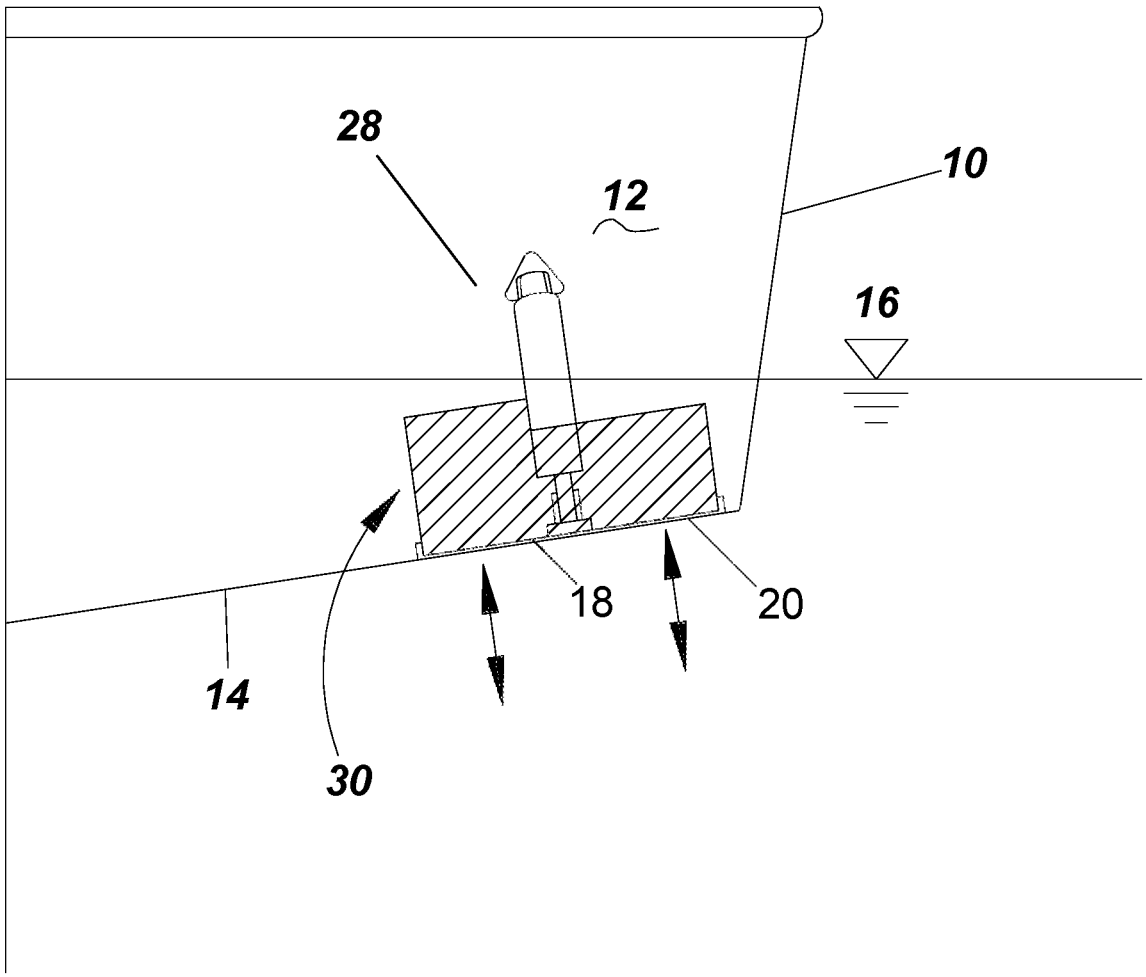
FIG. 1 is a pictorial rear view of an actuator style trim tab with buoyant material.
Figure 2:
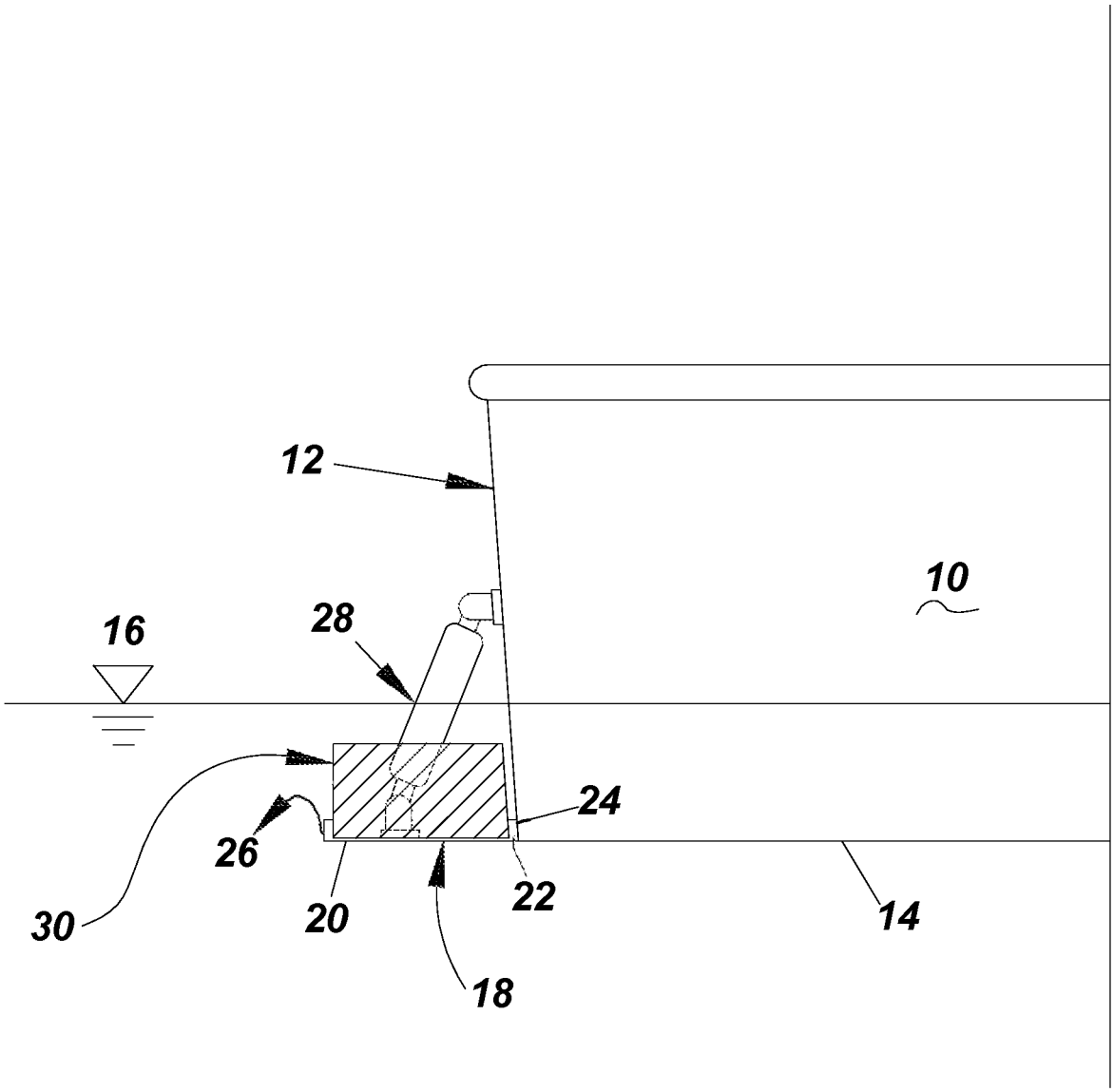
FIG. 2 is a pictorial side view thereof.
Figure 3:
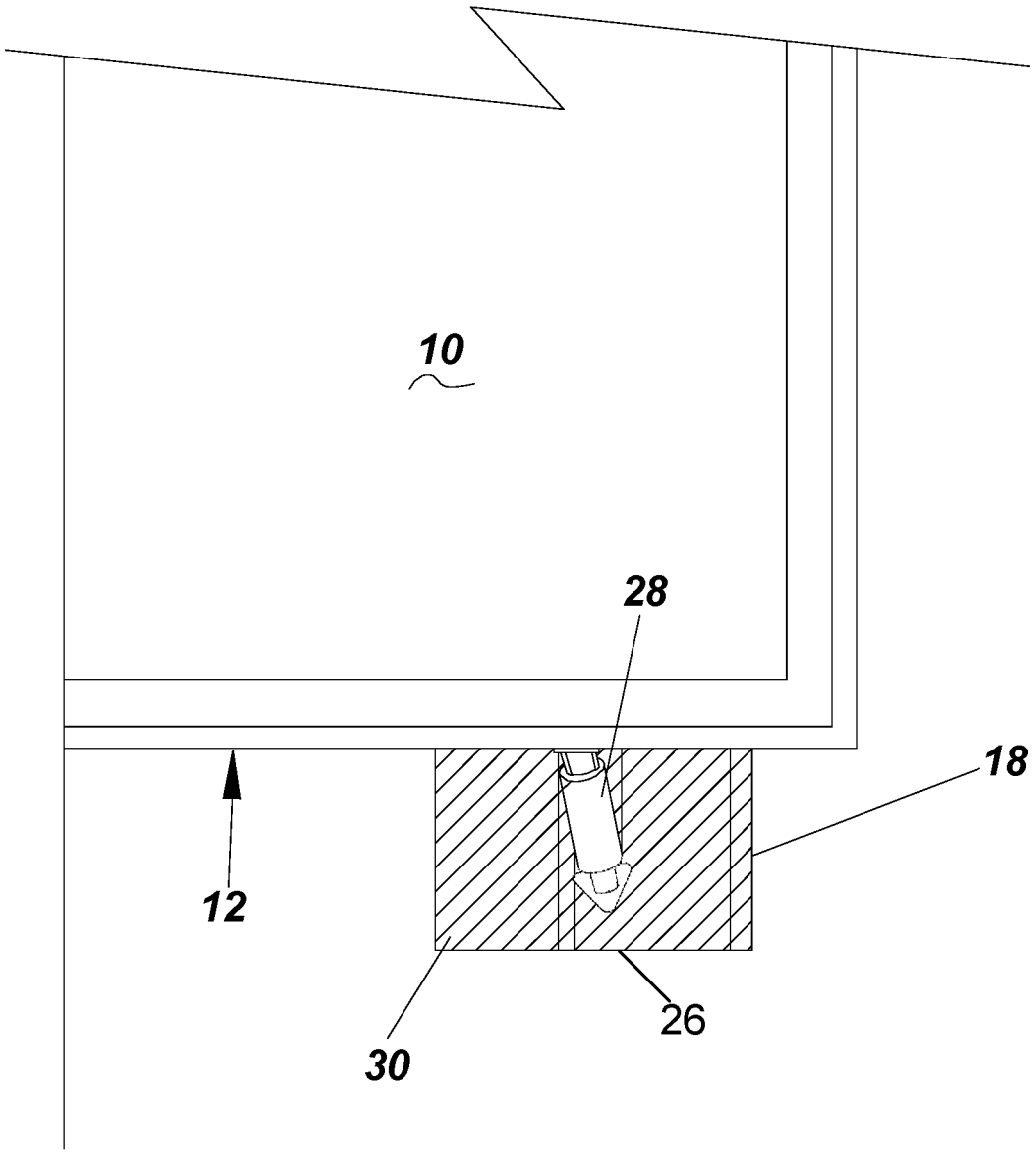
FIG. 3 is a pictorial top plane view thereof.
Figure 4:
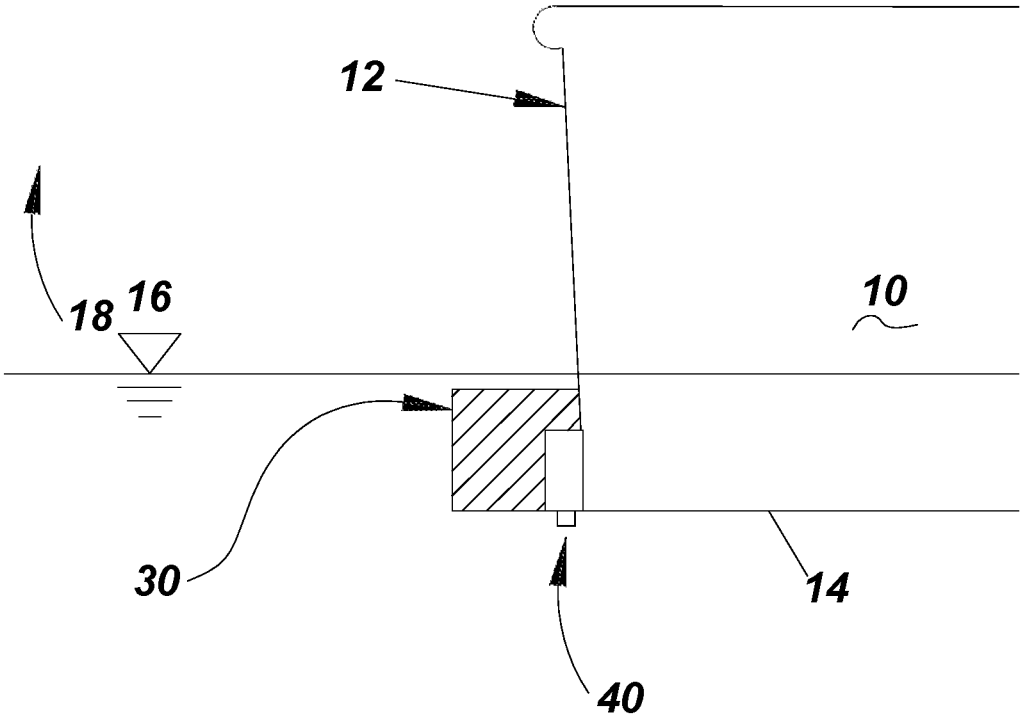
FIG. 4 is a pictorial side view depicting a blade type trim tab.
Figure 5:
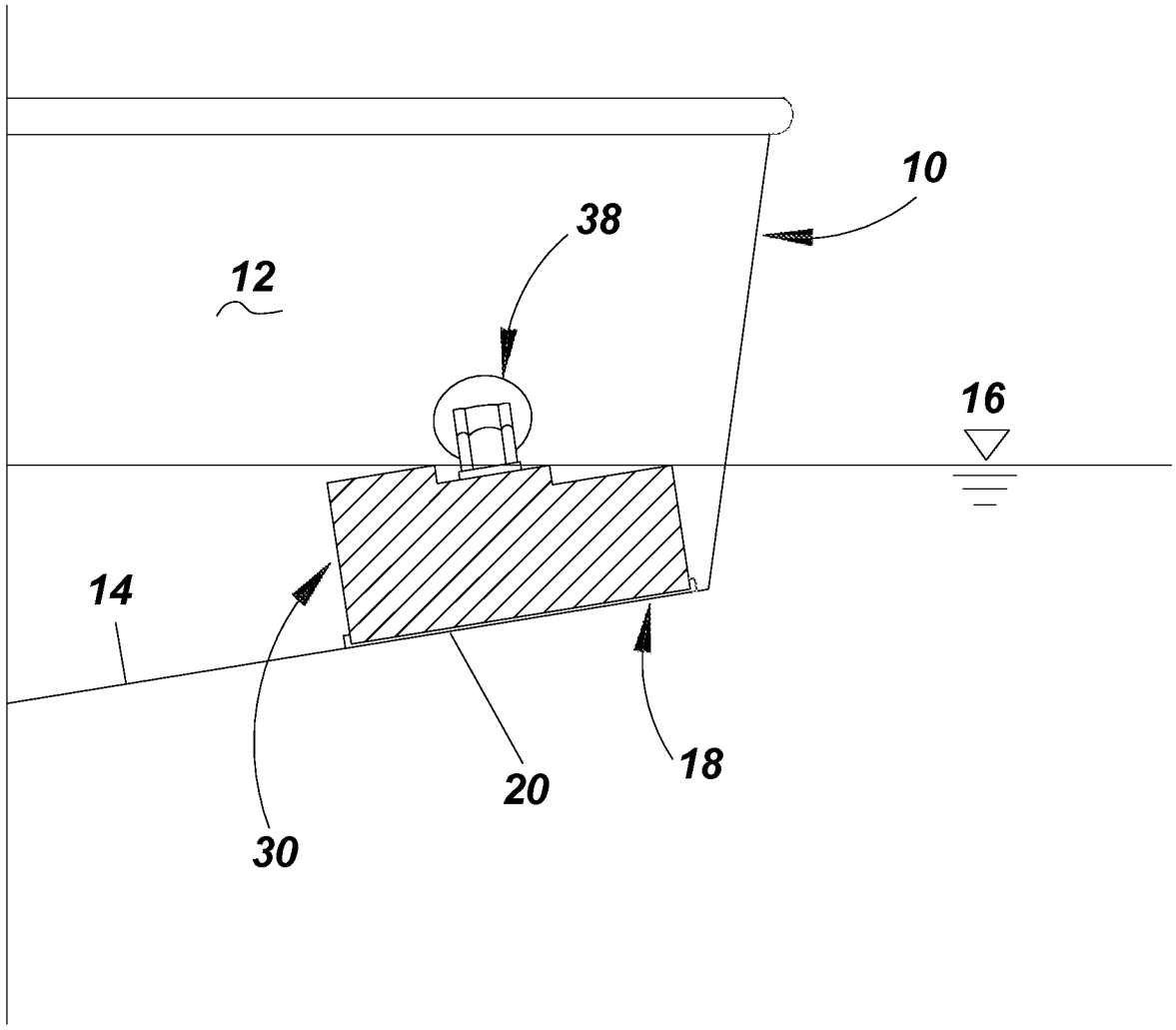
FIG. 5 is a pictorial rear view of a fixed trim tab with buoyant material.
Figure 6:
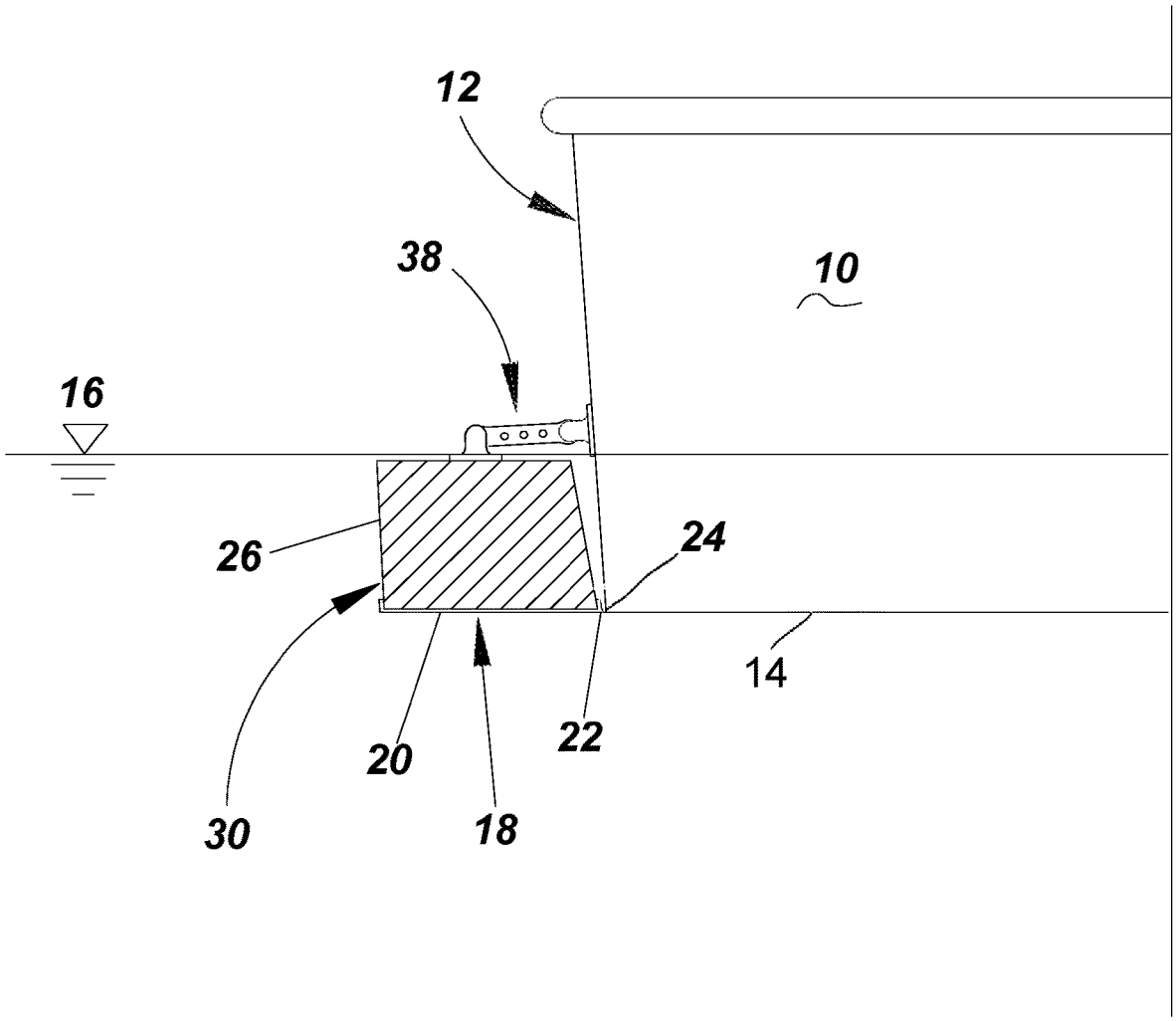
FIG. 6 is a pictorial side view thereof.
Figure 7:
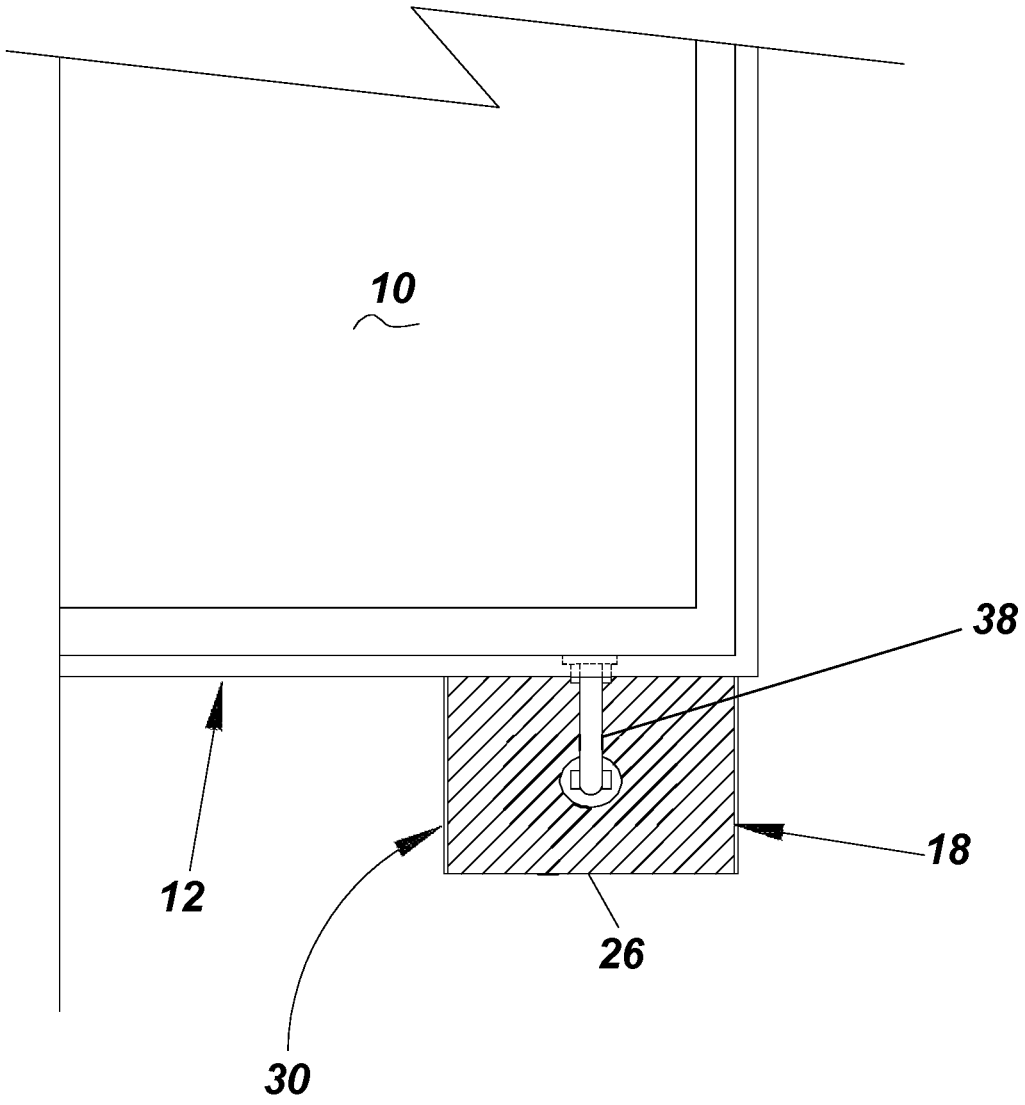
FIG. 7 is a pictorial top plane view thereof.

Referring to the Figures in general, depicted is the hull (10) of a boat having a transom (12). The bottom (14) of the boat illustrated below the water line (16). In one embodiment a trim tab (18) is formed from a plate (20) having a proximal edge (22) coupled to the transom (12) by a hinge (24). The distal end (26) can be raised or lowered by an actuator (28). A buoyant material (30) such as foam, encapsulated foam, another material significantly less dense than water, or hollow structures of plastic, metal, fiberglass, composite, or other materials is attached to the trim tab (18). The attachment would be by adhesive or mechanical fasteners. In another embodiment, the planing surface of the trim tab (18) would be manufactured from a buoyant material such as foam, encapsulated foam, another material significantly less dense than water, or hollow structures of plastic, metal, fiberglass, composite, or other materials. The plate (20) of the trim tab (18) would have some significant thickness to it, and be less dense than water, to achieve buoyancy. As shown in the FIG. 4, the same buoyant materials (30) or types of assemblies can be added to the newer vertically extending "interceptor" blade type trim tabs (40). As shown in FIGS. 5, 6, and 7, the distal end of the trim tab (18) can be fixed in a certain position by an arm or arms or bracket or brackets (38) extending from the trim tab to the vessel. The arm(s) or bracket(s) can be fixed, or be adjustable, such as with a jack screw or mating bolt holes, wherein the trim tab is manually adjustable to an optimum position. In another embodiment, the trim tab assembly could contain an opening (not shown) which could be used for storage, as a fish box, or as a live well. In another embodiment, the trim tab assembly could contain, or could contain a space for, a fathometer/fish finder transducer, a camera (such as an underwater camera), or lighting (such as underwater lighting), not shown.

Boats that sit too low in the water at the stern would benefit from additional flotation at the aft end. Additional flotation at the aft end of a boat raises the aft end higher in the water while the boat is at rest. This added flotation can keep the scuppers through the transom above the water line. This can keep a passenger's feet dry while the boat is being used at rest, but can also keep a boat from sinking at the dock if water is slowly entering the bilge and the bilge pump is inoperable. This added flotation can also keep the painted waterline, or boot stripe, above the water line, preventing marine fouling. Perhaps the most commonly useful thing additional flotation can do, is keep the lower unit(s) of an outboard motor or motors out of the water, or higher in the water, when the motors are tilted up, thus preventing or reducing marine fouling of the lower unit(s).

Many boats also list to one side while at rest in the water. This can be inherent to the hull, but is normally due to imbalanced loading, such as the placement of a marine battery, a kicker motor, dive tanks, stowing of gear, etc. This invention can be used to compensate for the imbalanced loading, by providing more flotation at the trim tab on the lower side of the boat than at the trim tab on the higher side.

A large number of boats suffer from sitting too low in the water at the aft end while at rest. At times, this has been tolerated at some cost. At other times, this has been remedied with relatively expensive bolt-on motor brackets. One inconvenient and inefficient solution has been to place counterweights (such as buckets of water) on the bow while the boat is at rest, to try to raise the stern. However, since many boats already have trim tabs, and many more would benefit from trim tabs, a simple, relatively inexpensive way to provide additional flotation at the stern is to incorporate it into the trim tabs, which this invention does.

An example of the effectiveness of the buoyancy compensation is evident by the following example wherein a boat has two trim tabs, one on the port side and one on the starboard side, each measuring 18" wide by 12" fore and aft. An assembly or material with the density of closed cell Styrofoam is added to the upper surface of each trim tab, to a thickness of about 6" above the trim tab upper surface providing approximately 1.5 total cubic feet of flotation. Subtraction of about 15% leaves space for an actuator, leaving 1.275 cubic feet. The Styrofoam has a density of just over 3 lb/cu.ft. Freshwater has a density of approximately 62 lb./cu.ft. and seawater has a density of approximately 64 lb./cu.ft. For this example a difference in density of 59 lb./cu.ft. is employed. Wherein 1.275 cu.ft.×59 lb./cu.ft. yields approximately 75 lbs. of extra flotation. This is roughly equivalent to getting rid of about 9 gallons of water out of the stern of the boat.

A preferred embodiment of the invention is to manufacture the blade using stainless steel plate, with built in, such as welded on, mechanical attachments (snaps, clamps, pins, clips, slots, rails, etc.). Buoyant blocks could then be manufactured in various standard sized modules which could be assembled on top of the plate using the built-in fasteners to achieve the desired thickness of flotation. For interceptor type trim tabs, the same concept could be employed. Alternatively, the trim tab plates, or the interceptor assembly, could be manufactured as a thick, buoyant assembly. Add-on assemblies designed to be attached to trim tabs would be useful as well. Again, they could be attached using adhesives or mechanical fasteners, such as bolts or clips.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The term "about" or "approximately" means the stated value plus or minus 5%. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

What is claimed is:

1. A buoyancy trim tab assembly for a motor boat transom, said buoyancy trim tab assembly comprising:

a first plate member defined by an upper surface, a lower planing surface, opposing side edges, a first end edge hingedly secured to the starboard side of the motor boat transom and a first outboard edge extending outwardly therefrom;

a first buoyant material secured to said lower planing surface of said first plate member, said buoyant material providing positive buoyancy to the starboard side transom area while the motor boat is motionless in the water;

a second plate member defined by an upper surface, a lower planing surface, opposing side edges, a second end edge hingedly secured to the port side of the motor boat transom and a second outboard edge extending outwardly therefrom; and a second buoyant material secured to said lower planing surface of said second plate member, said second buoyant material providing positive buoyancy to the port side transom area while the motor boat is motionless in the water.

2. The buoyancy trim tab assembly according to claim 1 wherein said buoyant material is attached to each said plate member by adhesive.

3. The buoyancy trim tab assembly according to claim 1 wherein said buoyant material is secured to each said plate member with a mechanical fastener.

4. The buoyancy trim tab assembly according to claim 1 wherein said buoyant material is constructed from a material that is less dense than water.

5. The buoyancy trim tab assembly according to claim 4 wherein said buoyant material is selected from the group consisting of: foam, encapsulated foam, hollow structure of plastic, metal, fiberglass, or composite.

6. The buoyancy trim tab assembly according to claim 1 wherein said buoyant material is attached to the upper surface of each said plate member.

7. The buoyancy trim tab assembly according to claim 1 wherein said buoyant material is attached to an interceptor type trim tab.

8. The buoyancy trim tab assembly according to claim 1 wherein a first actuator is constructed and arranged to angularly adjust said first outboard end edge and said starboard transom area while the motor boat is moving through water, and a second actuator is constructed and arranged to adjust said second outboard end edge and said port transom area of the motor boat.

9. The buoyancy trim tab assembly according to claim 8 wherein said first and second actuator is electric.

10. The buoyancy trim tab assembly according to claim 8 wherein said first and second actuator is hydraulic.

11. The buoyancy trim tab assembly according to claim 8 wherein said first and second actuator are manually adjustable.

12. The buoyancy trim tab assembly according to claim 1 wherein said buoyant material includes a storage area.

13. A method of providing buoyancy to the transom of a boat comprising the steps of:

calculating the amount of buoyancy required to the transom of the boat;

selecting the type of buoyant material to meet said buoyancy required;

sizing said buoyant material to trim tab dimensions;

securing said buoyant material to a lower surface of a starboard trim tab, said first buoyant material providing positive buoyancy to the starboard transom area of a boat while the boat is motionless in the water; and securing a second buoyant material to a lower surface of a port trim tab, said second buoyant material providing positive buoyancy to the port transom area of a boat while the boat is motionless in the water.

14. The method of providing buoyancy to the transom of a boat according to claim 13 wherein said step of securing includes the step of applying adhesive between said trim tab and said buoyant material.

15. The method of providing buoyancy to the transom of a boat according to claim 13 including the step of securing said buoyant material to said trim tab with a mechanical fastener.

16. The method of providing buoyancy to the transom of a boat according to claim 13 wherein said buoyant material is selected from the group consisting of: foam, encapsulated foam, other materials with a density less than that of water, hollow structure of plastic, metal, fiberglass, composite.

* * * * *